US005111371A

United States Patent [19]

Nielson

[11] Patent Number: 5,111,371

[45] Date of Patent: May 5, 1992

[54] ARC-STREAM CORRECTING LAMP HOLDER

[75] Inventor: Wayne G. Nielson, Hutchinson, Minn.

[73] Assignee: Sterner Lighting Systems Incorporated, Winsted, Minn.

[21] Appl. No.: 601,941

[22] Filed: Oct. 22, 1990

[51] Int. Cl.[5] ..... F21V 19/02

[52] U.S. Cl. ..... 362/261; 362/287; 362/427

[58] Field of Search ..... 362/261, 263, 285, 287, 362/418, 427, 428

[56] References Cited

U.S. PATENT DOCUMENTS

| | | | |
|---|---|---|---|
| 3,103,574 | 9/1963 | Chellis et al. | 362/261 |
| 3,590,238 | 6/1971 | Arens | 240/25 |
| 3,624,386 | 11/1971 | Plumadore | 362/261 |
| 3,648,045 | 3/1972 | Le Vantine et al. | 240/44.2 |
| 4,002,894 | 1/1977 | Kintz | 362/261 |
| 4,016,150 | 5/1991 | Gordin et al. | 362/263 |
| 4,076,359 | 2/1978 | Brownlee | 339/32 R |
| 4,261,030 | 4/1981 | Hernández | 362/263 |
| 4,290,096 | 9/1981 | Szpor | 362/263 |
| 4,472,769 | 9/1984 | Hoke et al. | 362/403 |
| 4,675,794 | 6/1987 | Fink, Jr. et al. | 362/289 |
| 4,729,077 | 3/1988 | Gordin et al. | 362/289 |
| 4,811,177 | 3/1989 | Lauckhardt et al. | 362/220 |
| 4,839,781 | 6/1989 | Barnes et al. | 362/299 |
| 5,029,058 | 7/1991 | Hirose et al. | 362/263 |

*Primary Examiner*—Richard R. Cole
*Attorney, Agent, or Firm*—Kinney & Lange

[57] ABSTRACT

A holder includes a support member and a reflector coupled to the support member. The reflector comprises a reflecting member with a predetermined focal axis for reflecting a portion of electromagnetic radiation in a preselected direction from an electromagnetic transmissive envelope placed adjacent the reflector. The envelope comprises an elongated source of electromagnetic radiation extending between two points within the envelope and which is displaced from a straight line. Rotatable receiving assemblies mounted to the support member position the envelope adjacent to the reflector with the envelope axis substantially parallel to the focal axis where rotation of the envelope axis around the focal axis compensates for the displacement of the elongated source.

12 Claims, 5 Drawing Sheets

ARC-STREAM CORRECTING LAMP HOLDER

BACKGROUND OF THE INVENTION

The present invention relates to lamp holders and, more particularly, to an arc discharge lamp holder that compensates for movement of the arc within the arc lamp due to the effect of gravity.

In many applications, it is desired to have an electromagnetic radiation source that radiates electromagnetic waves on a particular area. The electromagnetic radiation may be visible for direct observation, or the electromagnetic radiation may be in the non-visible spectrum, such as infrared. In the visible spectrum (light), such applications include sports stadiums, roadways, commercial interiors, and industrial applications, while in the non-visible spectrum, applications include police, military and other surveillance applications.

High intensity arc discharge lamps are commonly used for such applications. In arc discharge lamps, the electromagnetic radiation is derived from a plasma arc formed within an electromagnetic transmissive envelope or arc tube. One form of an arc discharge lamp that is currently employed is a metal halide lamp. In such lamps, the arc is ignited between two electrodes placed at opposite ends of the electromagnetic transmissive envelope. These electrodes define an envelope axis and are connected to a power supply which supplies the proper voltage and current for starting and operating the lamp.

Most arc discharge lamps also include a parabolic reflecting surface. The parabolic reflecting surface has a predetermined focal point or, if the reflecting surface has a longitudinal length, a focal axis. Commonly, the electromagnetic transmissive envelope is placed adjacent the reflecting surface with the envelope axis located on the focal axis in order to reflect electromagnetic radiation in any preselected direction.

Placement of the envelope axis on the focal axis of a parabolic reflecting surface, however, does not insure that the arc within the electromagnetic transmissive envelope, will remain on the focal axis.

When an arc is ignited within an electromagnetic transmissive envelope, the arc does not form on the envelope axis which is a straight line. In fact, the arc forms along an arched path above the envelope axis as it moves or displaces in a direction opposite from the earth's gravitational field. Since the envelope axis normally has been located on the focal axis, the arc arches off the focal axis. The net effect is that the lamp is not then optimally adjusted.

Although the arc will typically be located above the envelope axis, in relation to the reflector, the arc may be located closer to or farther away from the reflecting surface depending on the rotation of the reflecting surface about the focal axis. For example, if there is a desire to reflect electromagnetic radiation upward, the reflecting surface is positioned below the focal axis. With arc movement or displacement away from the earth's gravitational field, the arc is located above the focal axis at a position that is farther away from the reflecting surface than the focal axis. If, however, there is a desire to reflect electromagnetic radiation downward, then the reflecting surface is positioned above the focal axis. Upward arc displacement again causes the arc to be positioned above the focal axis but, in this situation, the arc is at a position that is closer to the reflecting surface than the focal axis. Therefore, the problem of mounting the arc lamp in a lamp holder is not merely to compensate for upward displacement of the arc within the envelope, but rather to provide a lamp holder that compensates for upward arc displacement given any orientation of the reflecting surface relative to that upward arc displacement.

SUMMARY OF THE INVENTION

The present invention relates to an adjustable lamp holder for an arc stream lamp that permits adjustment of the lamp holder to place the arc stream on a desired focal axis to compensate for the effect of the earth's gravitational field. The present invention provides a holder capable of supporting an electromagnetic transmissive envelope. The holder includes a support member and a reflector, having a desired axis, attached to the support member. The reflector is capable of reflecting a portion of electromagnetic radiation in a preselected direction from the electromagnetic transmissive envelope placed adjacent the reflector. The envelope comprises an elongated source of electromagnetic radiation extending between two points within the envelope and which stabilize within the envelope along on a path displaced from a straight line between the points.

The holder further comprises a first rotatable receiving assembly to support the envelope adjacent the reflector. The first rotatable receiving assembly is adjustable to substantially compensate for the determinable movement or displacement of the elongated source of electromagnetic such that the source positioned substantially on the desired axis.

DETAILED DESCRIPTION OF THE PREFERRED EMBODIMENTS

Figure 1:
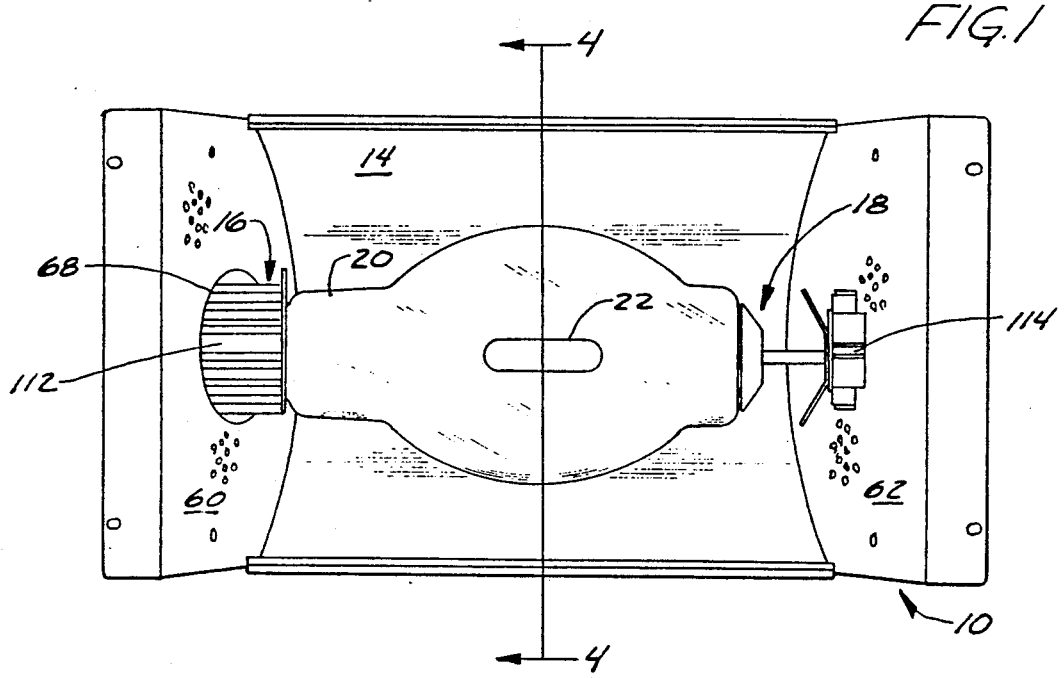
FIG. 1 is top plan view of a holder made according to the present invention.
Figure 2:
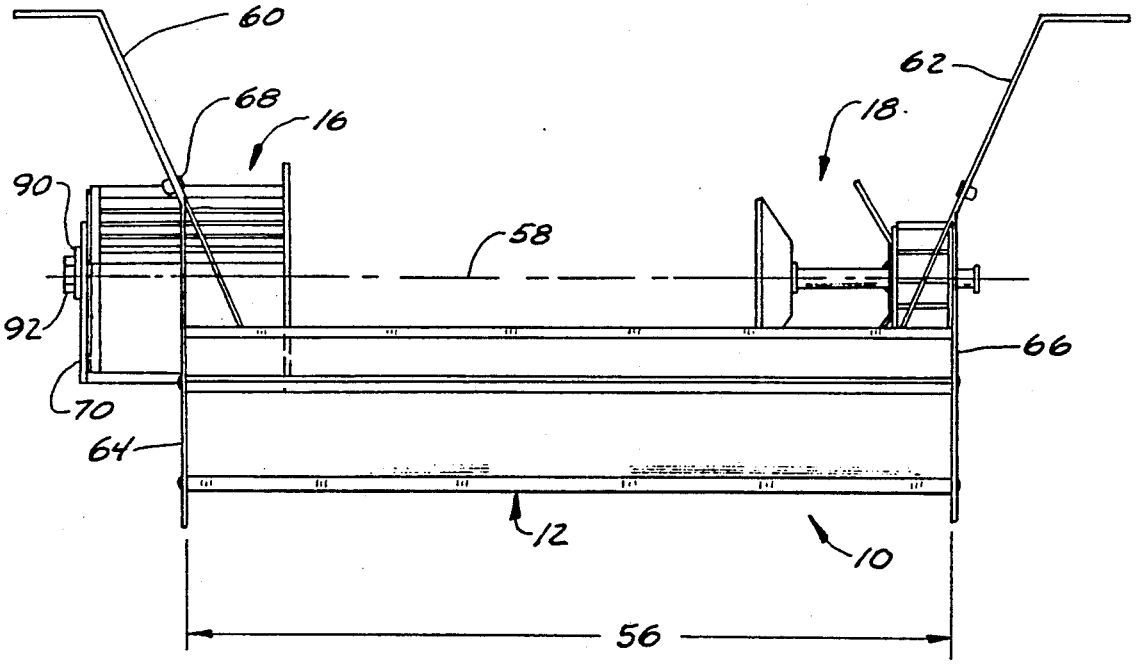
FIG. 2 is a longitudinal side elevation view of the holder of FIG. 1.

Referring now in detail to the figures wherein like reference characters represent like parts throughout several views, there is shown in FIGS. 1 and 2 a holder 10 of the present invention. Holder 10 includes a support member 12, a reflector 14, a first rotatable receiving assembly 16, and a second rotatable receiving assembly 18.

Shown in FIG. 1, an electromagnetic radiating enclosure or lamp 20 having an electromagnetic transmissive envelope 22 is supported by first and second rotatable receiving assemblies 16 and 18 adjacent reflector 14. Reflector 14 radiates a portion of the electromagnetic waves from a source of electromagnetic radiation within envelope 22 in a preselected direction. Common electromagnetic radiating enclosures include lamps emitting electromagnetic radiation in both the visible and non-visible spectrums. An example of a lamp that can be used with the holder 10 of the present invention is a metal halide arc lamp. The electromagnetic radiating enclosure 20 of FIG. 1 is shown in FIG. 3 as a typical metal halide arc lamp.

Figure 3:
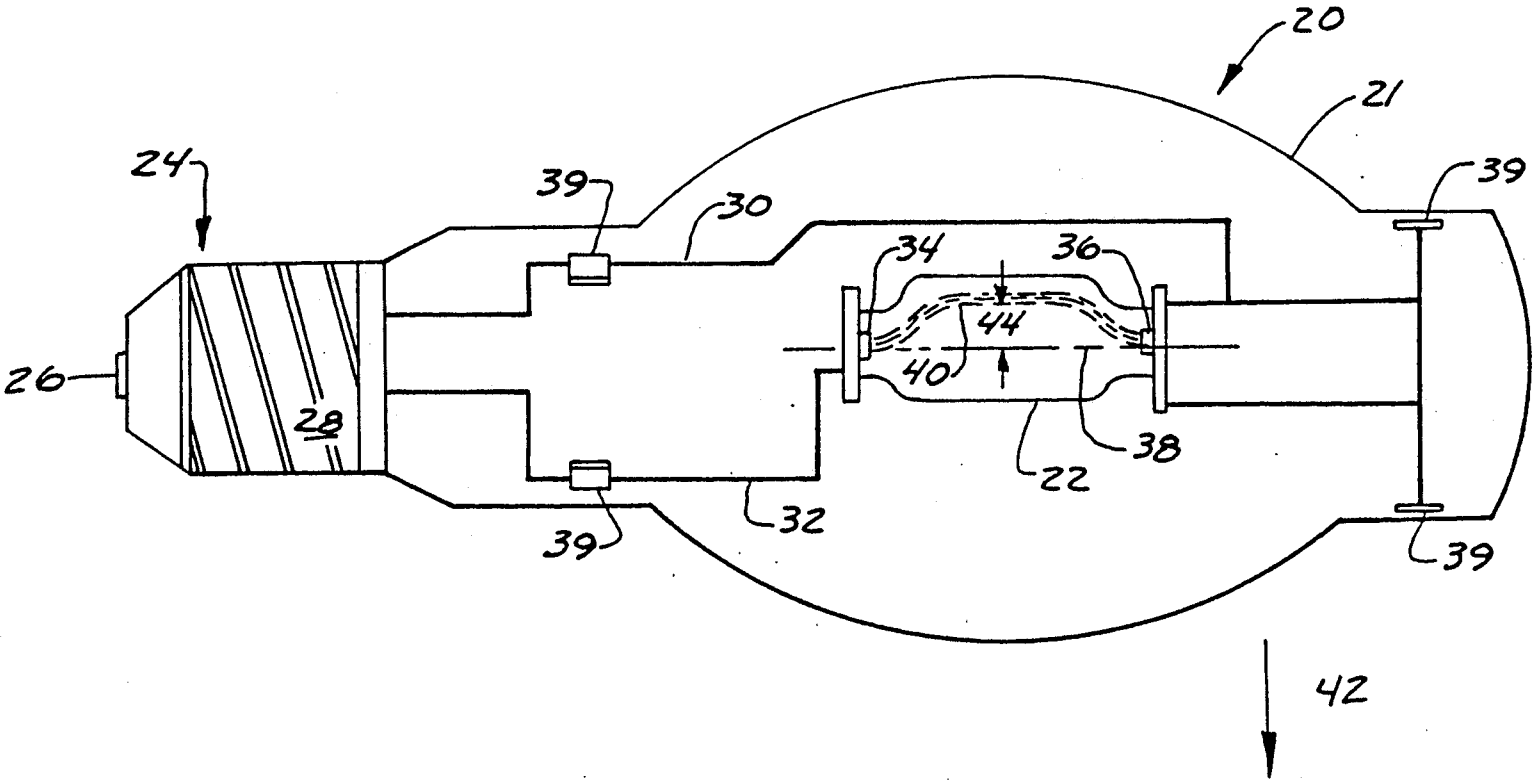
FIG. 3 is a perspective view of a metal halide lamp.

Referring to FIG. 3, lamp 20 has an outer radiation transparent enclosure 21 having a screw threaded end plug 24 that is screwed into a complementary receptacle or connector, not shown. End plug 24 has electrical connection locations 26 and 28 to which sufficient voltage and current are applied to operate lamp 20. Electrical connections 26 and 28 are electrically connected through conductors 30 and 32 to electrodes 34 and 36. Electrodes 34 and 36 are located at either ends of the electromagnetic transmissive envelope 22 which is enclosed in enclosure 21. The center of points of electrodes 34 and 36 define an envelope or lamp axis 38. The envelope 22 is held stationary with respect to the outer enclosure 21 of lamp 20 by conductor support bars 39 attached to conductors 30 and 32.

In metal halide arc lamps of the type shown in FIG. 3, an elongated arc 40 struck between electrodes 34 and 36 comprises the electromagnetic radiating source. However, as shown in FIG. 3, arc 40 does not form between electrodes 34 and 36 co-axial with envelope axis 38, but rather arches into a path other than a straight line spaced from envelope axis 38. Displacement of arc 40 to this arched position is readily determinable in that such movement is opposite from and a function of earth's gravitational field. Normal orientation of lamp 20 in holder 10 of FIG. 1 is placement of envelope axis 38 substantially horizontal, which is perpendicular to gravitational forces that are generated in a direction 42 from earth's gravitational field. Since arc movement or displacement is opposite direction 42, arc 40 is located above envelope axis 38 a distance represented by double arrow 44 that is at a maximum approximately equal to 0.156 inches for a standard metal halide lamp. It is important to note that rotation of lamp 20 about envelope axis 38 will not affect the direction of the arch of the arc relative to a horizontal reference plane within envelope 22.

Figure 4:
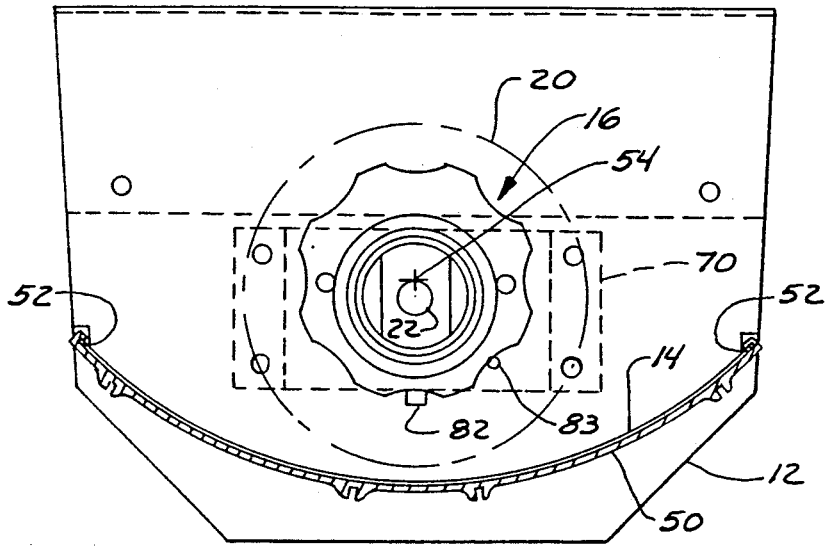
FIG. 4 is a sectional view taken along line 4—4 in FIG. 1.

Returning to holder 10 of the present invention, support member 12, as shown in FIG. 4, has an upper curved surface 50. Reflector 14 is mounted to support member 12 on upper curved surface 50 with edge grooves 52 formed longitudinally along support member 12. Upper surface 50 causes reflector 14 to have a generally parabolic cross-sectional curvature with a focal point 54. Since this parabolic curvature extends in cross section along length 56 of support member 12 shown in FIG. 2, a focal axis 58 is defined for reflector 14.

Referring back to FIG. 2, holder 10 also includes end reflectors 60 and 62. End reflectors 60 and 62 prevent electromagnetic waves from radiating in directions substantially different from the preselected direction. End reflectors 60 and 62 are mounted to corresponding end plates 64 and 66. End plates 64 and 66 are mounted to support member 12. First rotatable receiving assembly 16 projects through an aperture 68 in end reflector 60 and end plate 64, and is supported by a bracket 70 mounted to end plate 64. As shown in FIG. 1, first rotatable receiving assembly 16 supports lamp 20 of FIG. 3 adjacent reflector 14, and, as will be described later, compensates for arc displacement within envelope 22.

Figure 5A:
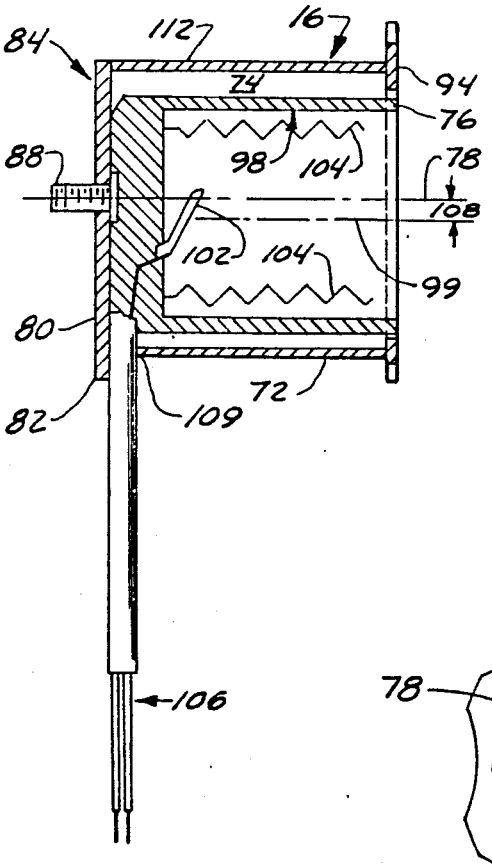
FIG. 5A is a sectional view of a first rotatable receiving assembly.
Figure 5B:
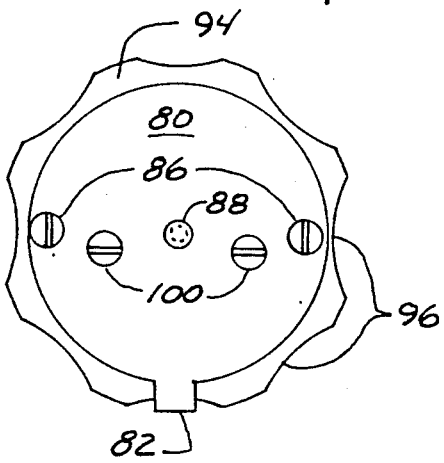
FIG. 5B is a rear elevational view of the first rotatable receiving assembly.

FIG. 5A is a sectional view of first rotatable receiving assembly 16. First rotatable receiving assembly 16 comprises a generally cylindrical housing 72 having an inside cavity 74, a front opening 76, and a center axis 78. A rear plate 80 with an extending tab 82 is secured to housing 72 at a rear end 84 with machine screws 86, shown in FIG. 5B, that engage threaded bores, not shown, in housing 72. A threaded bolt 88 is secured to rear plate 80 and, as shown in FIG. 5A, extends rearwardly from first rotatable receiving assembly 16 along center axis 78. Bolt 88 projects through a corresponding aperture of bracket 70 shown in FIG. 2. A washer 90 and a nut 92, also shown in FIG. 2, engage bolt 88 to secure first rotatable receiving assembly 16 to bracket 70 such that center axis 78 is substantially on focal axis 58. Nut 92 is tightened to provide sufficient frictional force between bracket 72 and rear plate 80 to retain first rotatable receiving assembly 16 in a stationary position but still allow forced rotational movement about focal axis 58. A front end plate 94, attached to housing 72 at front opening 76, has a plurality of gripping indentations 96, shown in FIG. 5B, to aid in manual rotation of first rotatable receiving assembly 16.

Figure 5C:
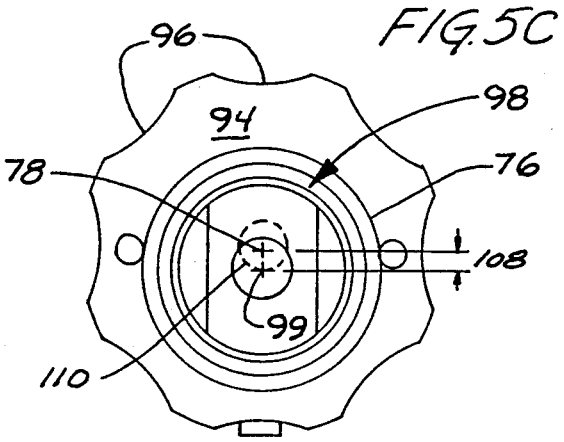
FIG. 5C is a front elevational view of the first rotatable receiving assembly.

Referring to FIGS. 5A and 5C, first rotatable receiving assembly 16 includes a lamp socket assembly 98 capable of accepting end plug 24 of lamp 20, shown in FIG. 3. Lamp socket assembly 98 supports lamp 20 such that envelope axis 38 is substantially on a lamp socket axis 99. Lamp socket assembly 98 is secured to rear plate 80 with fasteners 100, shown in FIG. 5B, and includes electrical connectors 102 and 104 that engage and electrically connect with electrical connection locations 26 and 28, respectively, of lamp 20. Electrical connectors 102 and 104 are further connected to wire leads 106 that provide sufficient voltage and current from a power supply, not shown, to maintain the arc within lamp 20. Wire leads 106 exit housing 72 through an opening 109 in housing 72.

As stated earlier, and shown in FIG. 2, first rotatable receiving assembly 16 is mounted to bracket 70 such that center axis 78, shown in FIG. 5A, is on focal axis 58. However, as shown in FIG. 5A and further in FIG. 5C, lamp socket assembly 98 is secured within housing 72 such that lamp socket axis 99 of lamp socket assembly 98 is displaced a distance indicated by double arrow 108 from center axis 78. Distance 108 is substantially equal to distance 44 of displaced arc 40 in lamp 20 of FIG. 3. Since lamp socket assembly 98 is offset within housing 72 from center axis 78 and focal axis 58 a distance 108, upward arching of the arc within envelope 22 is substantially compensated. With the arc displacement substantially compensated, the arc extends substantially along focal axis 58. As shown in FIG. 5C, rotation of first rotatable receiving assembly allows socket assembly axis 99 and envelope axis 38 to rotate around center axis 78 (and focal axis 58) along a path 110 to compensate for upward arc arching or displacement for different preselected directions of radiated electromagnetic waves. Full or continuous rotation of first rotatable receiving assembly 16 is prevented, as shown in FIG. 4, by tab 82 engaging a stop bar 83 attached to bracket 70. Engagement of tab 82 with stop bar 83 prevents excessive twisting of leads 106. An indicator strip 112, as best shown in FIG. 1, is provided on housing 72 radially opposite a vector formed from center axis 78 to lamp socket assembly axis 99. Indicator strip 112 is positioned on housing 72 to indicate upward movement of the arc. As will be described later, when first rotatable receiving assembly 16 is rotated to position indicator strip 112 upward, which is the direction of arc displacement, arc displacement is compensated and the arc is positioned substantially on the reflector focal axis.

Referring back to FIG. 1, further support for lamp 20 is provided by second rotatable receiving assembly 18. Second rotatable receiving assembly 18 projects through an aperture 114 of end reflector 62. As shown in FIG. 2, second rotatable receiving assembly 18 is mounted substantially parallel to focal axis 58 but, as will be described below, second rotatable receiving assembly 18 is also adjustable to compensate for arc displacement from a straight line.

Figure 6A:
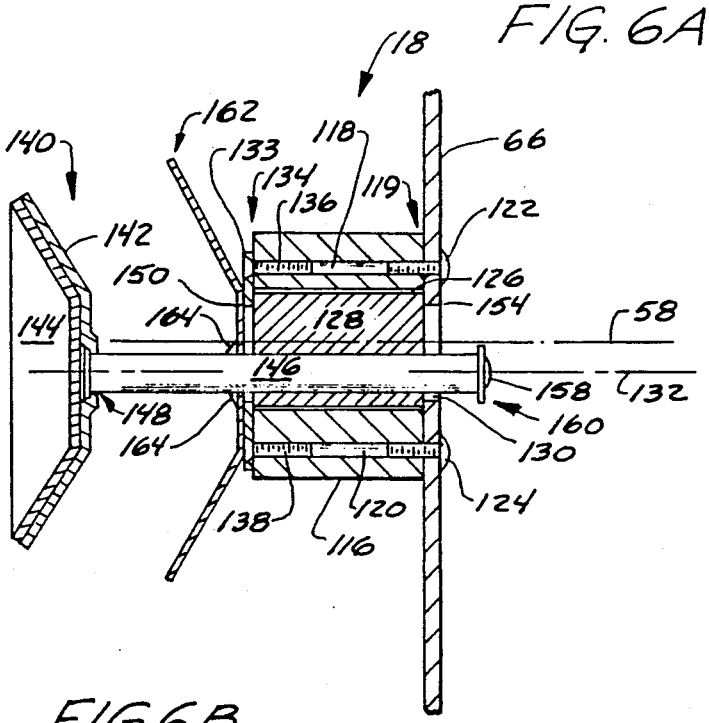
FIG. 6A is a sectional view of a second rotatable receiving assembly.

FIG. 6A is a sectional view of second rotatable receiving assembly 18. Second rotatable receiving assembly 18 comprises a housing 116 having threaded bores 118 and 120. Housing 116 is secured at a housing rear end 119 to end plate 66 with threaded bolts 122 and 124 engaged in threaded bores 118 and 120, respectively.

Housing 116 further comprises a cylindrical bore 126 that is centered on focal axis 58. Within bore 126, a cylindrical rotatable insert 128 is located. Insert 128 includes an offset bore 130 extending therethrough which has an offset bore axis 132 that is substantially parallel to focal axis 58. A plate 133 is attached to housing 116 at a housing front end 134 with bolts 136 and 138 engaged in threaded bores 118 and 120, respectively. Plate 133 retains insert 128 within housing 116.

Figure 6B:
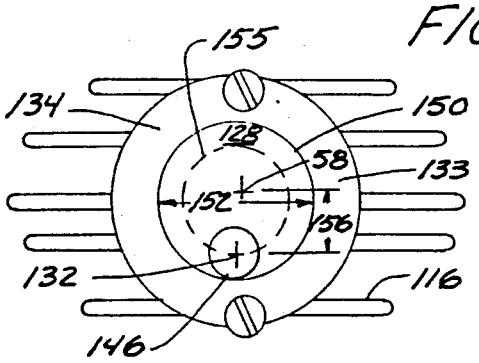
FIG. 6B is a front elevational view of the second rotatable receiving assembly with a lamp support assembly removed.

Offset bore 130, with a lamp support assembly 140 extending therethrough, also compensates for arc displacement within envelope 22 of FIG. 3. Lamp support assembly 140 comprises a lamp receiving cup 142, having a liner 144, attached to a shaft 146 at a shaft end 148. As best shown in FIG. 6B, an aperture 150 in plate 133 is centered on focal axis 58. Aperture 150, and a similar aperture 154 located in end plate 66 shown in FIG. 6A, both have diameters 152 sufficient to allow shaft 146, and thus lamp support assembly 140, to rotate around focal axis 58 along a circular path 155. A radial distance indicated by double arrow 156 from focal axis 58 to offset bore axis 132 is substantially equal to distance 44 of FIG. 3 and thus compensates for arc displacement.

Referring again to FIG. 6A, second rotatable receiving assembly 18 is adjustable to allow lamp installation. As described earlier, shaft 146 extends through offset bore 130 of insert 128. Shaft 146 has freedom of movement longitudinally along offset bore axis 132. Longitudinal movement of shaft 146 is limited by lamp receiving cup 142 at shaft end 148 and by a stop plate 158 secured to an opposite shaft end 160. A shaft retainer 162 with spring plates 164 that grip shaft 146 is provided. Shaft retainer 162 is positioned against plate 133 when lamp support assembly 140 has been properly positioned on the lamp. Shaft retainer 162, by gripping shaft 146, prevents lamp receiving cup 142 from approaching plate 133.

As stated earlier, the present invention allows determinable upward arc movement or displacement to be compensated preselected direction. Assuming, for example, there is a desire to radiate electromagnetic waves in a substantially horizontal direction, holder 10 would be oriented vertically as shown in FIG. 7.

Figure 7:
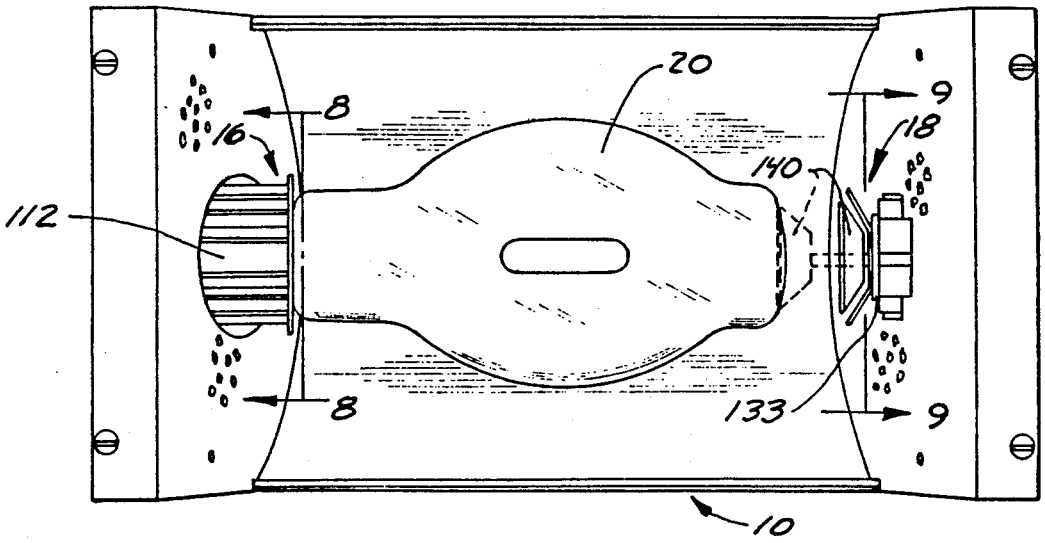
FIG. 7 is a front elevational view of a holder made according to the present invention.

FIG. 7 shows lamp support assembly 140 of second rotatable receiving assembly 18 proximate plate 133. As described above, movement of lamp support assembly 140 to this position is possible by longitudinal movement of shaft 146. With lamp support assembly 140 positioned as shown in FIG. 7, lamp 20, having a screwable end plug 24, shown in FIG. 3, can be installed in the lamp socket assembly located within first rotatable receiving assembly 16.

Figure 8:
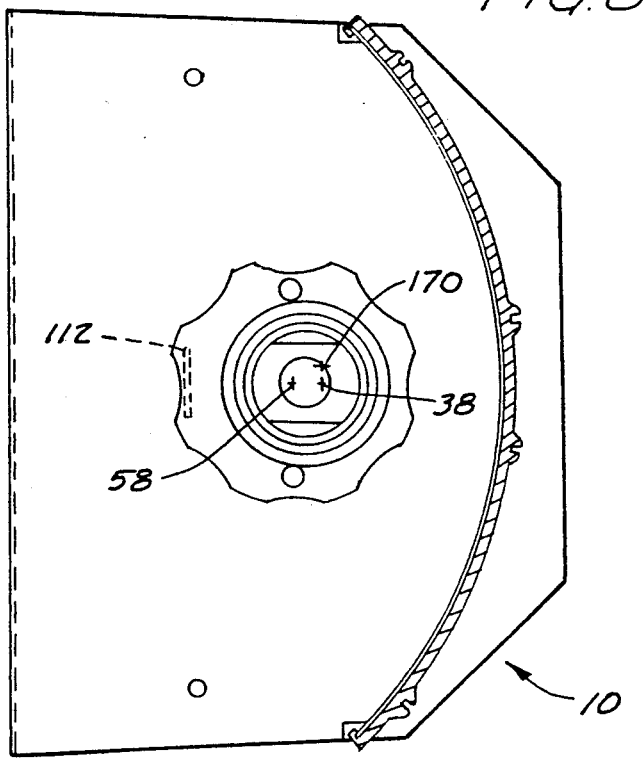
FIG. 8 is a sectional view taken along line 8—8 in FIG. 7.

FIG. 7 also shows indicator strip 112 oriented in substantially the same horizontal direction as the desired reflected electromagnetic waves. FIG. 8 is a cross-sectional view of holder 10 showing location of envelope axis 38 with respect to focal axis 58 given orientation of indicator strip 112 in this substantially horizontal direction. Since electrodes between which the arc extends define envelope axis 38 and displacement of the arc is upward opposite earth's gravitational field, an arc would be located substantially in cross section along an axis 170. With the arc located along axis 170 and not along focal axis 58, arc displacement is not compensated to optimally radiate electromagnetic waves in the preselected horizontal direction. Rotation of first rotatable receiving assembly 16 clockwise 90 degrees to a position shown in FIG. 8A however does position envelope axis 38 to compensate for arc displacement.

Figure 8A:
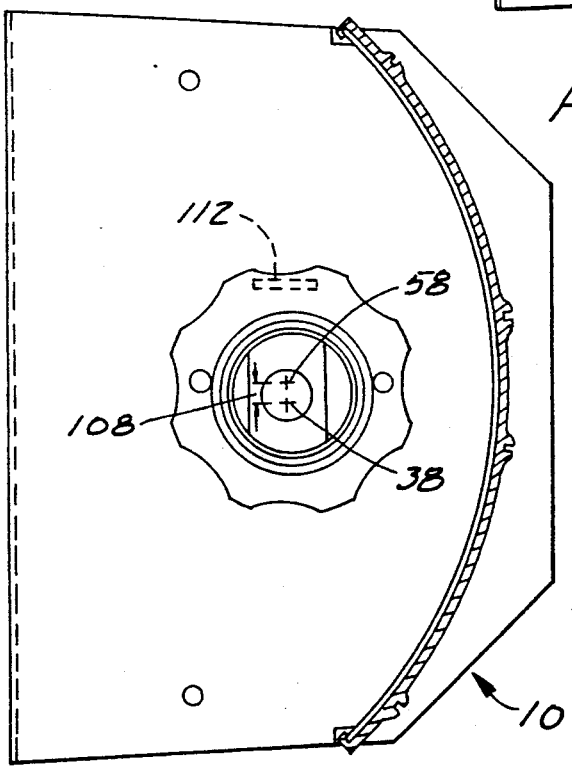
FIG. 8A is a sectional view taken along line 8—8 in FIG. 7 with 90 degree clockwise rotation of the first rotatable receiving assembly.

In FIG. 8A, indicator strip 112 is oriented above focal axis 58 to represent upward arc displacement. This orientation locates envelope axis 38 directly below focal axis 58. Since distance 108 equals the length of arc displacement, the arc is located substantially on focal axis 58 and holder 10 is properly adjusted to radiate electromagnetic waves in the preselected horizontal direction.

Figure 9:
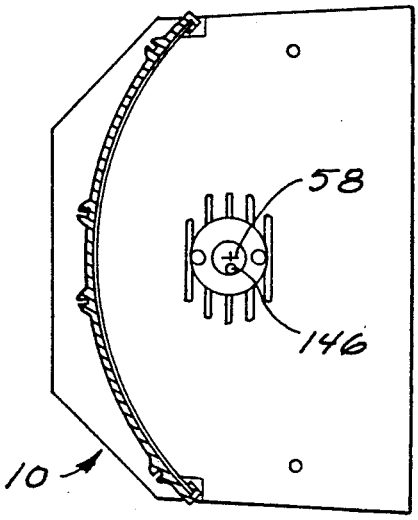
FIG. 9 is a sectional view taken along line 9—9 in FIG. 7.

Additional support for lamp 20 is provided by second rotatable receiving assembly 18. Shown in the cross-sectional view of FIG. 9, shaft 146 is positioned directly below focal axis 58 or in other words at a position directly opposite indicator strip 112 of first rotatable receiving assembly 16. Lamp support assembly 140 is then longitudinally moved to engage lamp 20 as shown in phantom in FIG. 7. As described above, shaft retainer 162 grips shaft 146 to prevent longitudinal movement of lamp support assembly 140 back toward plate 133.

In summary, the present invention provides a holder that compensates for determinable movement or displacement of an elongated source of electromagnetic radiation from a straight line between its end, such as an arc within a metal halide lamp. The first and second rotatable receiving assemblies, comprising the holder, support the lamp and provide quick and accurate adjustment of the lamp to compensate for arc displacement. With compensation of arc displacement, the holder is optimally adjusted to radiate electromagnetic waves in the preselected direction from any type of reflector having a predetermined focal point or axis, such as a parabolic reflector.

Although the present invention has been described with reference to preferred embodiments, workers skilled in the art will recognize that changes may be made in form and detail without departing from the spirit and scope of the invention.

What is claimed is:

1. A holder comprising:

a support member;

a reflector coupled to the support member, the reflector reflecting a portion of a electromagnetic radiation in a preselected direction from an electromagnetic transmissive envelope placed adjacent to the reflector, the envelope comprising an elongated source of electromagnetic radiation extending between two points which displaces a determinable amount within the envelope from a straight line between the points; and means for mounting the envelope to the support member and adjacent to the reflector such that the determinable displacement of the source of electromagnetic radiation is compensated and the source of electromagnetic radiation is positioned substantially on a desired axis relative to the reflector by displacing the envelope.

2. The holder of claim 1 wherein the two points of the envelope define an envelope axis, and the envelope is positioned adjacent to the reflector with the envelope axis substantially parallel to the desired axis.

3. The holder of claim 2 wherein the means for mounting the envelope comprises a first rotatable receiving assembly secured to the support member, the first rotatable receiving assembly rotating the envelope axis around the desired axis.

4. The holder of claim 3 and an indicator secured to the first rotatable receiving assembly, the indicator indicating a direction representative of electromagnetic radiation source movement such that rotation of the indicator to the direction representative of electromagnetic radiation source displacement positions the elongated source of electromagnetic radiation substantially on the desired axis.

5. The holder of claim 4 wherein the elongated electromagnetic radiation source comprises an arc formed within the envelope and displacement of the arc is opposite earth's gravitational field.

6. The holder of claim 1 wherein the reflector has a focal axis, the focal axis being the desired axis.

7. A holder comprising:

a support member;

a reflector coupled to the support member, the reflector having a predetermined focal axis, and reflecting a portion of electromagnetic radiation in a preselected direction from an electromagnetic transmissive envelope placed adjacent the reflector, the envelope comprising an elongated source of electromagnetic radiation extending between two points defining an envelope axis which is displaced a determinable amount within the envelope from a straight line between the two points; and a first rotatable receiving assembly mounted to the support member supporting the envelope such that the envelope axis is rotatable around the focal axis to position the elongated source of electromagnetic radiation substantially on the focal axis.

8. The holder of claim 7 and an indicator secured to the first rotatable receiving assembly, the indicator indicating a direction representative of electromagnetic radiation source movement such that rotation of the indicator to the direction representative of electromagnetic radiation source displacement positions the elongated source electromagnetic radiation substantially on the focal axis.

9. The holder of claim 8 and a second rotatable receiving assembly connected to the support member, the second rotatable receiving assembly further supporting the envelope such that the envelope axis is rotatable around the focal axis.

10. The holder of claim 9 wherein the source of electromagnetic radiation comprises an arc formed within the envelope and displacement of the arc is in opposite direction from the gravitational field of the earth.

11. A method for positioning an elongated source of electromagnetic radiation, extending between two points and having determinable displacement from a straight line within an electromagnetic transmissive envelope, substantially on a focal axis of a reflecting holder adjusted to project electromagnetic radiation in any preselected direction, the method comprising:

providing means for mounting the envelope on a rotatable receiving assembly connected to the holder such that an envelope axis is rotatable around the focal axis of the holder;

determining the displacement of the source of electromagnetic radiation within the envelope;

rotating the envelope axis about the focal axis until the elongated source of electromagnetic radiation is substantially on the focal axis.

12. The method of claim 11 wherein movement of the elongated source of electromagnetic radiation is in one direction; and the providing step includes providing an indicator secured on the rotatable receiving assembly indicating the direction of displacement of the electromagnetic radiation source; and the rotating step includes rotating the indicator to the position representative of that electromagnetic radiation source displacement.

* * * * *